US009770384B2

(12) United States Patent
Osman

(10) Patent No.: US 9,770,384 B2
(45) Date of Patent: Sep. 26, 2017

(54) DUAL-MODE CANE, A KIT FOR CONVERTING A WHITE CANE TO A DUAL-MODE CANE, AND A METHOD FOR CONVERTING A WHITE CANE TO A DUAL-MODE CANE

(71) Applicant: Martin Seymour Osman, Newton Highlands, MA (US)

(72) Inventor: Martin Seymour Osman, Newton Highlands, MA (US)

( * ) Notice: Subject to any disclaimer, the term of this patent is extended or adjusted under 35 U.S.C. 154(b) by 0 days.

(21) Appl. No.: 14/821,211

(22) Filed: Aug. 7, 2015

(65) Prior Publication Data

US 2016/0150859 A1 Jun. 2, 2016

Related U.S. Application Data

(60) Provisional application No. 62/085,684, filed on Dec. 1, 2014.

(51) Int. Cl.

| | |
|---|---|
| ***A45B 9/04*** | (2006.01) |
| ***A61H 3/06*** | (2006.01) |
| *A61H 3/02* | (2006.01) |

(52) U.S. Cl.

CPC ..... *A61H 3/068* (2013.01); *A45B 9/04* (2013.01); *A61H 3/0288* (2013.01)

(58) Field of Classification Search

CPC ..... A61H 3/0288; A61H 3/06; A61H 3/00; A61H 3/068; A45B 9/04; A45B 3/00; Y10S 135/911

USPC ..... 135/65–66, 77, 84, 86, 911; 280/819, 280/823; 297/272.1, 272.4; 108/144.11, 108/147; 367/99, 107

See application file for complete search history.

(56) References Cited

U.S. PATENT DOCUMENTS

| | | | | |
|---|---|---|---|---|
| 960,700 A | | 6/1910 | Pratt | |
| 1,429,428 A | * | 9/1922 | Hipwood | A61H 3/0288 135/86 |
| 1,663,622 A | * | 3/1928 | Atkinson | A45B 9/04 135/86 |
| 2,642,884 A | * | 6/1953 | Henderson | A45B 9/00 135/65 |
| 5,088,513 A | * | 2/1992 | Ostermeyer | A61H 3/0288 135/82 |
| 5,680,673 A | * | 10/1997 | Beshore | A47B 91/06 16/42 R |

(Continued)

FOREIGN PATENT DOCUMENTS

| | | |
|---|---|---|
| CN | 202605226 U | 12/2012 |
| FR | 1159491 | 11/1956 |

(Continued)

OTHER PUBLICATIONS

UK Intellectual Property Office, Search report for application No. GB1521023, dated Apr. 25, 2016.

*Primary Examiner* — Winnie Yip
(74) *Attorney, Agent, or Firm* — Davis, Malm & D'Agostine, P.C.

(57) ABSTRACT

A dual-mode cane includes a tip. The tip includes a low-friction surface that contacts a walking surface when the tip rests on the walking surface at an angle less than or equal to a transition angle. The tip includes a high-friction surface that contacts the walking surface when the tip rests on the walking surface at an angle greater than or equal to the transition angle.

9 Claims, 12 Drawing Sheets

(56) References Cited

U.S. PATENT DOCUMENTS

| | | | | |
|---|---|---|---|---|
| 5,810,038 | A | 9/1998 | Carpinella | |
| 5,934,300 | A * | 8/1999 | Breton | A61H 3/068 135/65 |
| 6,910,246 | B2 * | 6/2005 | Desmarais | A47B 91/066 16/42 R |
| 7,234,199 | B2 * | 6/2007 | Bushey | A47B 91/06 16/42 R |
| 8,408,224 | B2 * | 4/2013 | Ozuna | A45B 9/04 135/65 |
| 8,720,459 | B2 | 5/2014 | Moulton | |
| 2004/0040105 | A1 * | 3/2004 | Hillenbrand | A47L 13/10 15/104.001 |
| 2009/0199885 | A1 * | 8/2009 | Baker | A61H 3/02 135/71 |
| 2010/0018005 | A1 * | 1/2010 | Bushey | A47B 91/06 16/42 T |
| 2013/0061894 | A1 * | 3/2013 | Liu | A45B 9/04 135/82 |

FOREIGN PATENT DOCUMENTS

| | | | |
|---|---|---|---|
| GB | 191322171 | A | 10/1914 |
| WO | 2007058180 | A1 | 5/2007 |
| WO | 2008094103 | A1 | 8/2008 |

* cited by examiner

DUAL-MODE CANE, A KIT FOR CONVERTING A WHITE CANE TO A DUAL-MODE CANE, AND A METHOD FOR CONVERTING A WHITE CANE TO A DUAL-MODE CANE

TECHNICAL FIELD

The device and methods disclosed herein relate generally to devices to assist the visually impaired, and particularly to dual-mode white canes to assist the visually impaired.

BACKGROUND ART

Many partially-sighted and blind persons use a straight-handled cane in a searching mode to detect hazardous obstacles in their path. These canes are frequently painted white or covered with a white reflective tape. The color warns others of the user's condition and enhances the visibility of the user. This type of cane has come to be known generically as "the white cane," or "the long cane." When in use, the cane handle is held like the railing of a down-staircase. While the user walks forward, the lower end of the cane rests on the ground and is swung left and right in a searching mode. Some users with sensitive ears intersperse the arc motion with a bouncing of the tip to create impulsive tapping sounds that produce echoes that can give information about the immediate environment.

One of the early improvements was to make the cane's contact surface out of a material that would minimize the friction between the ground and the cane end. A further improvement came with the replacement of the fixed tip by a spherical or cylindrical rotating tip. In common parlance these new tips are called "rolling" tips, and it must be understood that they do not roll in the forward direction but only left and right. The movement of the roller is like that of a barrel being moved by rolling it on its bottom edge. When used in its search mode, the resistance to forward motion of the cane is determined mainly by the frictional characteristics of the material of which the tip is constructed. The rolling friction of the roller is negligible. With these improvements, the white cane has been used unchanged in basic design for many years.

Paradoxically, those characteristics that have added to the white cane's ease of use come with perils, especially for those individuals who occasionally inadvertently try to use the cane for support. The white cane has such low friction with a flat surface that it affords no purchase at all. In short, white canes cannot be used as a prop or buttress against fall due to momentary imbalance. However, there are many instances when a user might welcome that capability. Some examples are: tripping, losing balance in a lurching train or bus, rising from a seat, managing an excessively steep incline, and exiting from a vehicle. The need for stable behavior at various times from the white cane is especially critical for our aging population. The use of a second cane for support requires the user to carry two canes, which is tiring, and limits mobility in other ways by occupying the user's hands.

Therefore, there remains a need for a white cane suitable for both searching and support as needed. The Dual-Mode Cane satisfies this need.

SUMMARY OF THE EMBODIMENTS

In one aspect, a dual-mode cane includes a tip. The tip includes a low-friction surface that contacts a walking surface when the tip rests on the walking surface at an angle less than or equal to a transition angle. The tip includes a high-friction surface that contacts the walking surface when the tip rests on the walking surface at an angle greater than or equal to the transition angle. Thus, the two surfaces make contact with the ground in a mutually exclusive manner.

In a related embodiment, the low-friction surface is substantially cylindrical. In another embodiment, the low-friction surface is substantially hemispheroidal. In an additional embodiment, the low-friction surface is substantially disc-shaped. In yet another embodiment, the low-friction surface is substantially pear-shaped. In another embodiment still, the high-friction surface is substantially hemispheroidal. In a further embodiment, the high-friction surface is a filleted disc. In another embodiment, the high-friction surface is adhered to the low-friction surface. In a further embodiment still, the high-friction surface is embedded in the low-friction surface. In an additional embodiment, the tip has a basal portion to which the low-friction surface is attached. In another embodiment, the low-friction surface is free to rotate relative to the basal portion about an axis. In yet another embodiment, the high-friction surface is affixed to the basal portion. In an additional embodiment, the transition angle is between 40 degrees and 60 degrees. A further embodiment includes a shaft having a proximal end and a distal end attached to the tip. An additional embodiment includes a handle attached to the proximal end of the shaft.

In another aspect, a kit for converting a white cane to a dual-mode cane includes an attachment having a high-friction surface. The kit includes an adhesive for adhering the attachment to a white cane tip.

In another aspect a method for converting a white cane to a dual-mode cane includes providing a white cane having a low-friction tip. The method includes providing an attachment having a high-friction surface. The method includes affixing the attachment to the low-friction tip so that the low-friction tip contacts a walking surface when the cane forms an angle with a walking surface that is less than or equal to a transition angle and the high-friction surface contacts the walking surface when the cane forms an angle with the walking surface that is greater than or equal to the transition angle.

In a related embodiment, the low-friction tip is radially symmetrical about a first axis, the high-friction surface is radially symmetrical about a second axis, and affixing the attachment to the low-friction tip further involves affixing the attachment to the low-friction tip so that the first axis aligns with the second axis. In an additional embodiment, affixing the attachment further includes adhering the attachment to the low-friction tip.

Other aspects, embodiments and features of the disclosed device and method will become apparent from the following detailed description of the invention when considered in conjunction with the accompanying figures. The accompanying figures are for schematic purposes and are not intended to be drawn to scale. In the figures, each identical or substantially similar component that is illustrated in various figures is represented by a single numeral or notation at its initial drawing depiction. For purposes of clarity, not every component is labeled in every figure. Nor is every component of each embodiment of the device and method shown where illustration is not necessary to allow those of ordinary skill in the art to understand the device and method.

BRIEF DESCRIPTION OF THE DRAWINGS

The preceding summary, as well as the following detailed description of the disclosed device and method, will be better understood when read in conjunction with the attached drawings. It should be understood that the invention is not limited to the precise arrangements and instrumentalities shown.

DETAILED DESCRIPTION OF THE INVENTION

Figure 1A:
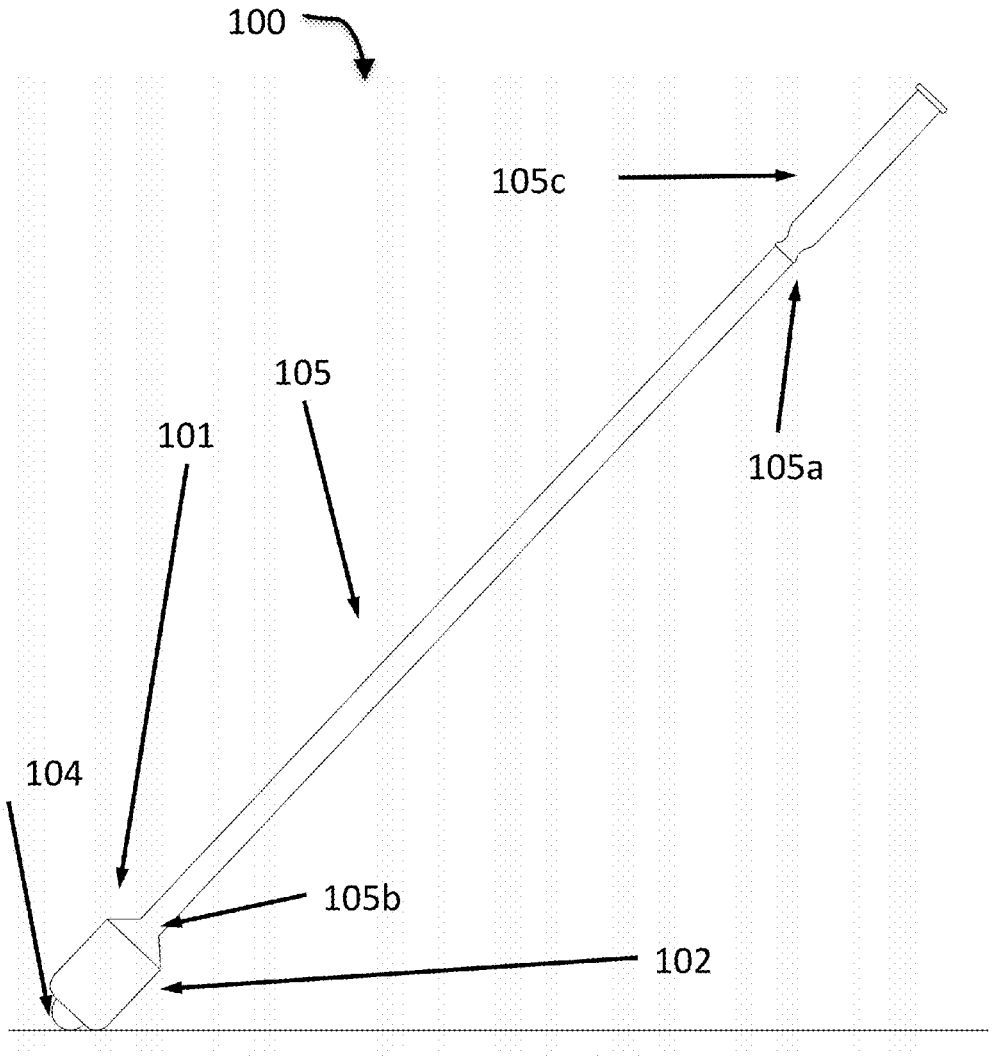
FIG. 1A is a schematic diagram illustrating one embodiment of a dual-mode cane having a hemispheroidal attachment.
Figure 1B:
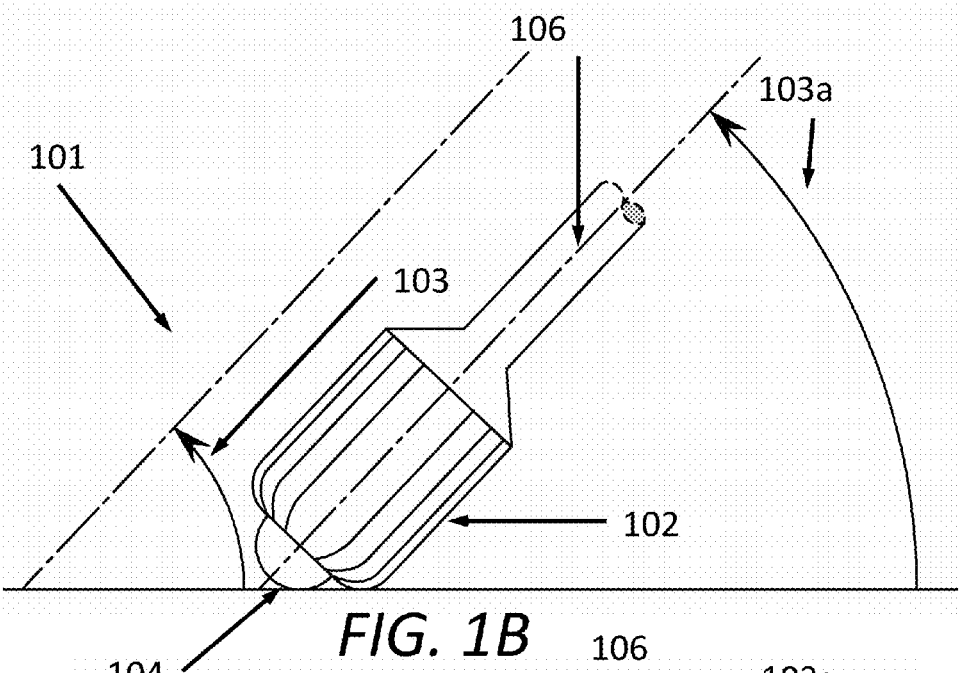
FIG. 1B is a schematic diagram illustrating one embodiment of a dual-mode cane.

Embodiments of the disclosed dual-mode cane enable a visually impaired user to rely on a single cane both for searching out a path in the surrounding terrain and for aiding in stability as needed. The dual-mode cane presents a very low-friction contact to the ground when the user holds the dual-mode cane at a typical angle used for searching the ground with a white cane. If the user angles the cane more steeply, it engages the ground with a higher degree of friction, giving the cane purchase and allowing the user to rely on the cane for some stability or support.

FIGS. 1A-1F illustrate some embodiments of a dual-mode cane 100. The dual mode cane 100 includes a tip 101. The tip 101 includes a low-friction surface 102. The tip 101 may be formed so that the low-friction surface 102 contacts the walking surface when the tip 101 rests on the walking surface at an angle less than a transition angle 103. The tip 101 includes a high-friction surface 104. The tip 101 may be formed so that the high-friction surface 104 contacts the walking surface when the tip 101 rests on the walking surface at an angle greater than or equal to the transition angle 103.

As shown in FIG. 1A, the dual-mode cane 100 may include a shaft 105. In some embodiments, the shaft 105 has a proximal end 105*a* and a distal end 105*b*. The tip 101 may be mounted on the distal end 105*b* of the shaft 105. The tip 101 may be mounted to the distal end 105*b* using any materials or means used to attach a tip to a cane, including a screw or other fastener, adhesion, a bulldog hook, a cord, or a press or friction fit. The shaft 105 may have any form used for any part of a white cane, support cane, or any other walking mobility aid. The shaft 105 may be constructed of any materials or combination of materials suitable for the construction of a cane. Without limitation, materials making up the shaft 105 may include wood, metal, natural polymers, synthetic polymers such as plastics, resins, fiber-reinforced plastics such as graphite-reinforced plastics, fiberglass, glass, or ceramics.

In some embodiments, the shaft is an elongate structure designed to be held near the proximal end 105*a* with the distal end 105*b* contacting the walking surface; the shaft may have a length suitable for use as a walking support substantially perpendicular to the walking surface, with the proximal end reaching between the waist and mid-abdomen of the user. In other embodiments, the shaft 105 is longer; for instance, the shaft 105 may have a length that makes the cane suitable for use as a "long cane." The shaft 105 may have a length suitable for use as a "guide cane." The shaft 105 may make the cane 100 long enough to reach the user's sternum when placed perpendicularly to the walking surface with the tip 101 resting on the walking surface. The shaft 105 may be longer; the shaft 105 may have any length suitable for a white cane. The shaft 105 may be straight or curved.

The shaft 105 may be made of a single monolithic piece. The shaft 105 may be constructed of a plurality of pieces joined together. The pieces may be movable with respect to one another. The shaft 105 may be collapsible: that is, a user may be able to move the plurality of parts making up the shaft 105 relative to one another to reduce the length of the shaft 105. In one embodiment, the shaft 105 includes a plurality of rigid sections that can be folded up. For instance, each of the plurality of rigid sections may be strung on a cord, and the user may be able to join the ends of the sections together or pull them apart, folding them against each other; the cord may be elastic, holding the sections in their joined state unless the user pulls them apart. In other embodiments, the shaft 105 includes a plurality of telescoping rigid sections; in some embodiments, the shaft 105 further includes latching mechanisms that can fix the telescoping sections relative to each other in one or more positions, making the length of the shaft 105 adjustable.

The part or parts making up the shaft 105 may have any suitable cross-sectional form, including a circular profile (i.e., making the part in question a cylinder), an elliptical profile (making the part in question an elliptical cylinder), any regular or irregular polygonal profile, including rectangular or square profiles, a star-shaped or scalloped profile, or any combination of the above-described cross-sectional profiles. The cross-sectional profile of each part making up the shaft 105 may vary over the length of the part. Each part making up the shaft may have a similar or different shape to any other part making up the shaft. Any part of the shaft 105, or the shaft as a whole, may be hollow; for instance, the shaft may have a substantially tubular form.

The shaft may be able to support part of the weight of a user. In some embodiments, the shaft 105 is sufficiently strong for the cane 100 to function as a support cane, on which a user can lean for support while walking; the cane may be strong enough to support substantially all of the weight of the user. In other embodiments, the shaft 105 is weaker; for instance, the shaft 105 may have a light structure suitable for use in an extended position to search out the walking surface in front of a user, with the ability to support a limited amount of weight to help a user gain additional stability. As a non-limiting example, the shaft 105 may be the shaft of a "jumbo cane," usable as a white cane, but having enhanced structural strength to allow some use for support as well. The shaft 105 may include a handle 105*c* at its proximal end 105*a*. The handle 105*c* may be any handle or grip suitable for use with a cane.

The cane 100 may be held by a user with the tip 101 in contact with the walking surface. As used herein, the walking surface is the surface on which the user is moving; the walking surface may include any natural or artificial walking surface. The walking surface may include a floor, such as a wooden, carpeted, tiled, or linoleum floor. The walking surface may include a paved surface such as concrete or asphalt; the paved surface may include, without limitation, a driveway, walkway, sidewalk, or street surface. The walking surface may include a natural surface, such as grass, dirt, sand, gravel, or rock. The walking surface may have a flat surface, or an irregular surface; for instance, the walking surface may include a first portion that is raised relative to a second portion, with a curb, inclined plane, or curved surface connecting the first and second portions. The walking surface may have a rough or uneven surface. The walking surface may include one or more obstructions, which may include, without limitation, plants, rocks, tussocks, cracks or holes in flat surfaces, or artificial structures; artificial structures may include any human construction set upon the walking surface, such as mailboxes, fire hydrants, telephone or light posts, retaining walls, stairs, curbs, potholes, protruding pipes, or buildings. Obstructions may include movable objects, such as bicycles, boxes, vehicles, parcels, or bags. Obstructions may include people or animals. The walking surface may include one or more stairs; for instance, the walking surface may include a stair above or below a stair on which the user is standing. One advantage of some embodiments of the dual-mode cane is its use on staircases, where its ability to aid in stability is especially useful.

The tip 101 includes a low-friction surface 102. In some embodiments, the low-friction surface 102 is a surface having a similar degree of friction or traction to the contact surfaces used for white canes; in other words, the shape of the low-friction surface 102, and the materials used for its construction, may combine to cause the contact of the low-friction surface 102 with the walking surface to provide very little resistance to sliding, where the walking surface is substantially flat. In some embodiments, the low-friction surface 102 has a static coefficient of friction on a hardwood or tile floor of 0.2 or less; in some embodiments, the low-friction surface 102 has an apparent coefficient of static friction of 0.2 or less on a hardwood or tile floor, where the apparent coefficient of static friction is the coefficient of static friction that would be empirically observed upon testing the cane on such a surface.

The low-friction surface 102 may be constructed of any material or combination of materials suitable for producing its low degree of friction. The low-friction surface 102 may be constructed of any material or materials used for white cane tips. The materials making up the low-friction surface 102 may include a low-friction polymer such as nylon. The materials making up the low-friction surface 102 may include metal, such as aluminum. The materials making up the low-friction surface 102 may include ceramics.

The low-friction surface 102 may have any shape suitable for use as a white cane tip. The low-friction surface 102 may have a substantially cylindrical form; the edges of the substantially cylindrical form may be filleted to improve gliding behavior. The low-friction surface 102 may have a substantially hemispheroidal form; the hemispheroid may be circular or elliptical in profile. The low-friction surface 102 may have a pear-shaped or droplet-like form. The low-friction surface 102 may have the form of a rod. The low-friction surface 102 may have the form of a rod that is bent so that the end of the rod is elevated above the walking surface, presenting a curved surface to the walking surface. The low-friction surface 102 may be disc-shaped; the disc may be filleted or partially toroidal. The low-friction surface 102 may be substantially spherical. The low-friction surface 102 may be journaled on a bearing that permits the low-friction surface 102 to rotate relative to an axis; the axis may be parallel to the shaft 105. The low-friction surface 102 may include, without limitation, a pencil tip, a marshmallow tip, a roller tip, a jumbo roller tip, a metal glide, a "bundu basher" tip, an all-terrain tip, a ball-face overfit tip, a pear tip, a rural tip, a rolling ball tip, or a ceramic tip. The object bearing the low-friction surface 103 may be hollow or solid.

The tip 101 includes a high-friction surface 104. In some embodiments, the high-friction surface 104 is a surface having sufficient friction or traction to be used as the tip of a support cane; the high-friction surface 104 may function similarly to a cane "stopper." In some embodiments, when the high-friction surface 104 is in contact with the walking surface, the tip 101 is difficult to slide relative to the walking surface. In some embodiments, the high-friction surface 102 has a static coefficient of friction on a hardwood or tile floor of 0.5 or more; in some embodiments, the high-friction surface 102 has an apparent coefficient of static friction of 0.5 or more on a hardwood or tile floor, where the apparent coefficient of static friction is the coefficient of static friction that would be empirically observed upon testing the cane on such a surface.

The high-friction surface 104 may be constructed from any suitable material or combination of materials. The high-friction surface 104 may be constructed from any material or combination of materials usable for the stopper of a support cane. The materials making up the high-friction surface 104 may include elastomeric materials, such as rubber or polyurethane polymer.

Figure 3A:
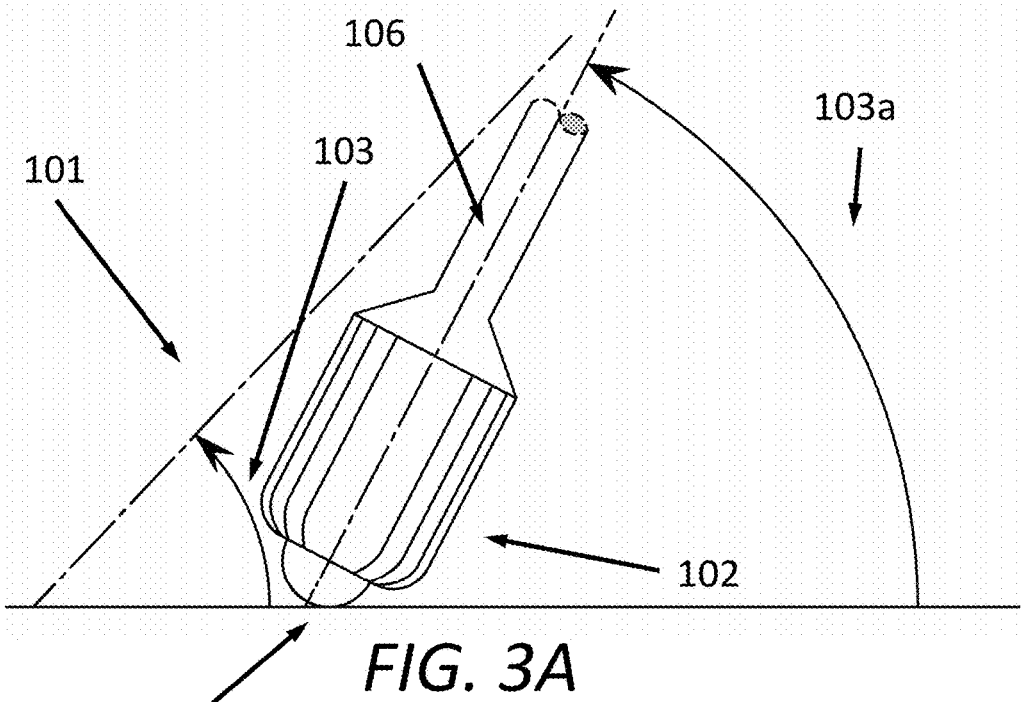
FIG. 3A is a schematic diagram illustrating one embodiment of a dual-mode cane.
Figure 3B:
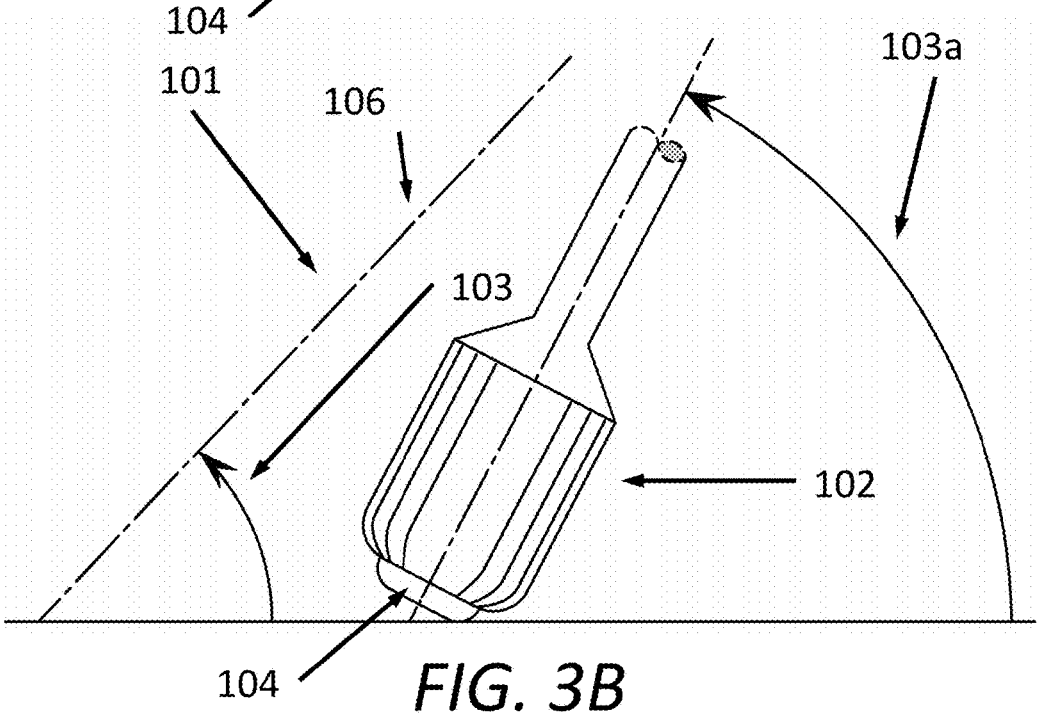
FIG. 3B is a schematic diagram illustrating one embodiment of a dual-mode cane.
Figure 3C:
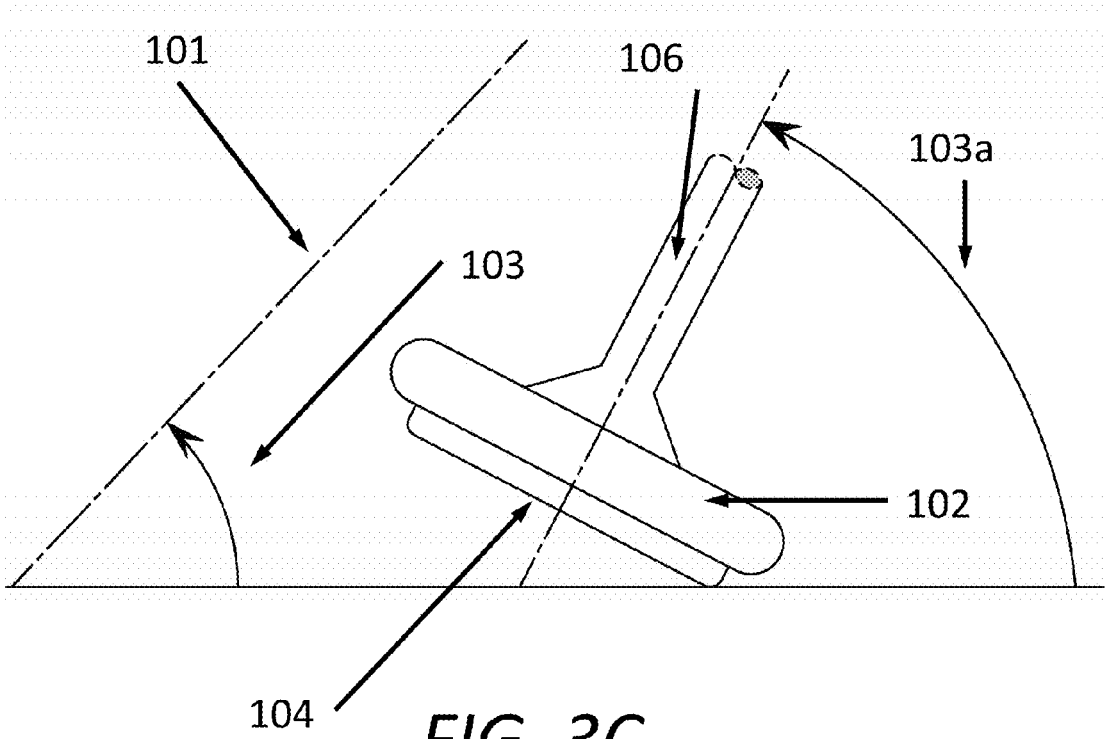
FIG. 3C is a schematic diagram illustrating one embodiment of a dual-mode cane.
Figure 4A:
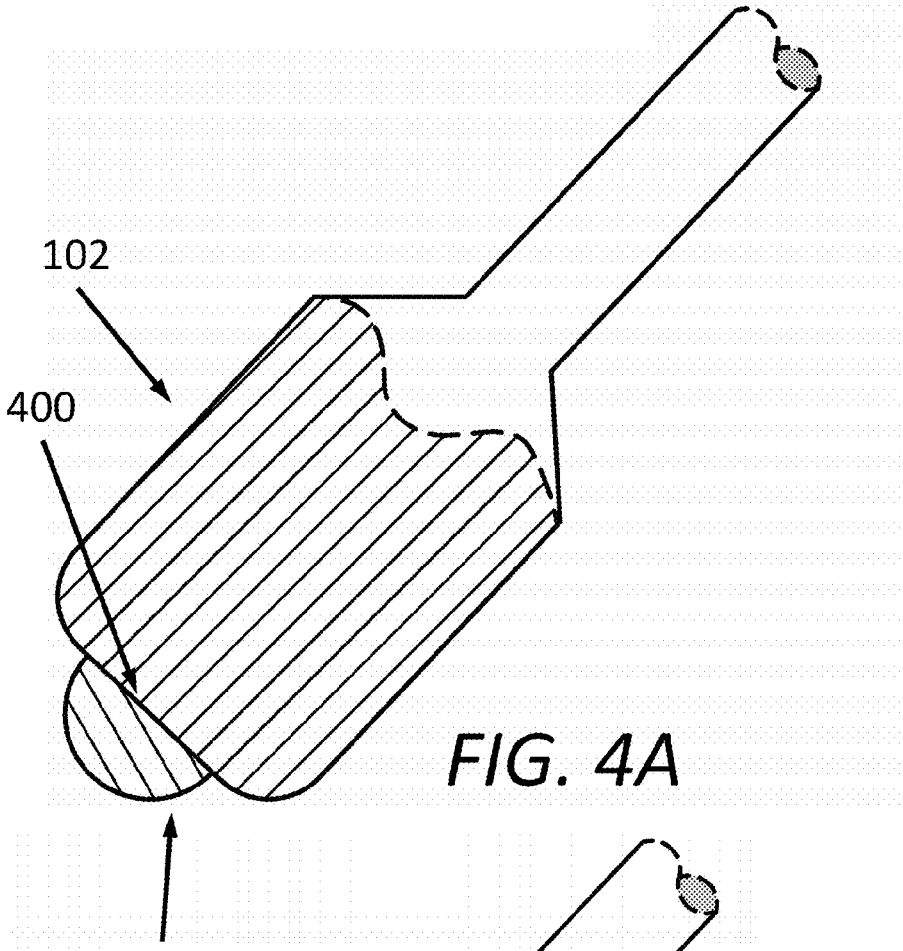
FIG. 4A is a schematic diagram illustrating a cross-section of an embodiment of a dual-mode cane.

The high-friction surface 104 may be attached to the low-friction surface 102. In some embodiments, as shown in FIG. 4A, the high-friction surface 104 is adhered to the low-friction surface. The object bearing the high-friction surface 104 may have an additional surface 400 that conforms to the shape of a portion of the low-friction surface 102; for instance, the object bearing the high-friction surface 104 may have a substantially flat back 400 that conforms to a substantially flat part of the low-friction surface 102. In some embodiments, a portion 400 of the high-friction surface 104 is adhesive; for instance, the high-friction surface may be provided as an adhesive-backed product, such as a bump-dot, bumper, door stop, vibration isolator, equipment support, or furniture pad. The portion 400 of the high-friction surface 104 may be attached to the low-friction surface 102 by any other suitable means for attaching the tip 101 to the distal end of the shaft 105 as described above in reference to FIGS. 1A-3C, including screws, fasteners, cords, or other means.

Figure 4B:
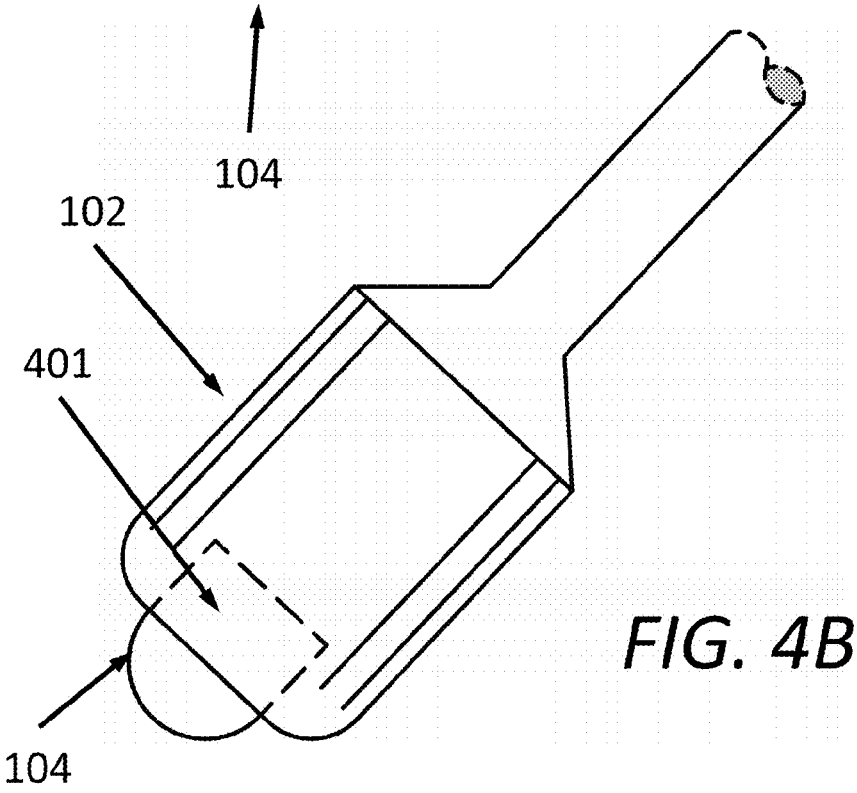
FIG. 4B is a schematic diagram illustrating an embodiment of a cane tip with an embedded high-friction attachment.
Figure 4C:
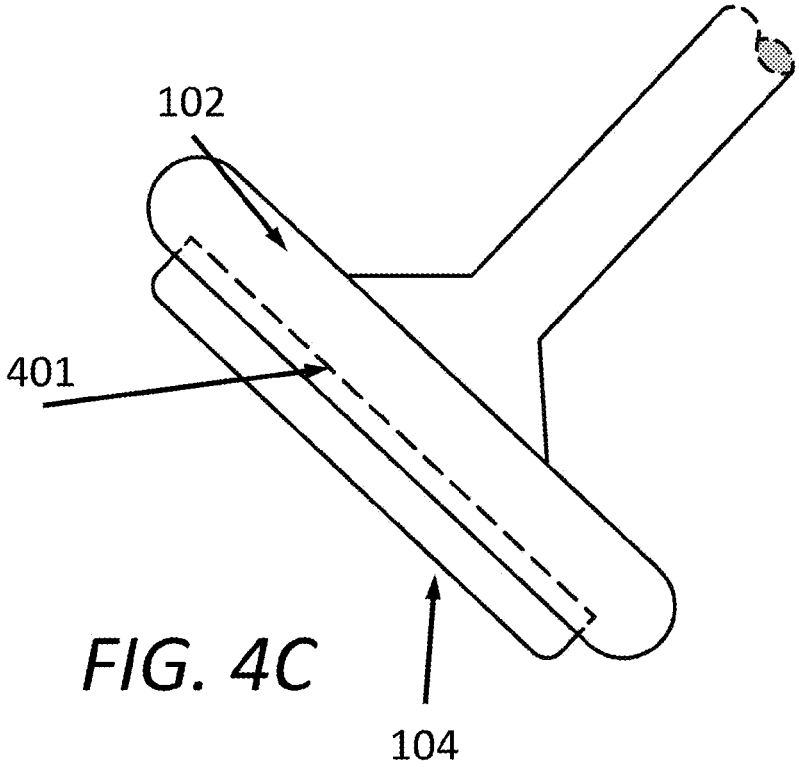
FIG. 4C is a schematic diagram illustrating a cross-section of an embodiment of a dual-mode cane.

In other embodiments, as shown in FIGS. 4B-4C, the high-friction surface is embedded in the low-friction surface; that is, the object bearing the high-friction surface may be embedded in an indentation 401 in the low-friction surface. The embedded object may be adhered within the indentation 401. The embedded object may fit snugly enough in the indentation 401 to remain in place due to friction. The embedded object may have one or more elements that engage corresponding elements in the indentation 401; for instance, the embedded object may have a flange or lip (not shown) that overlaps a corresponding flange or lip in the indentation 401.

Figure 4D:
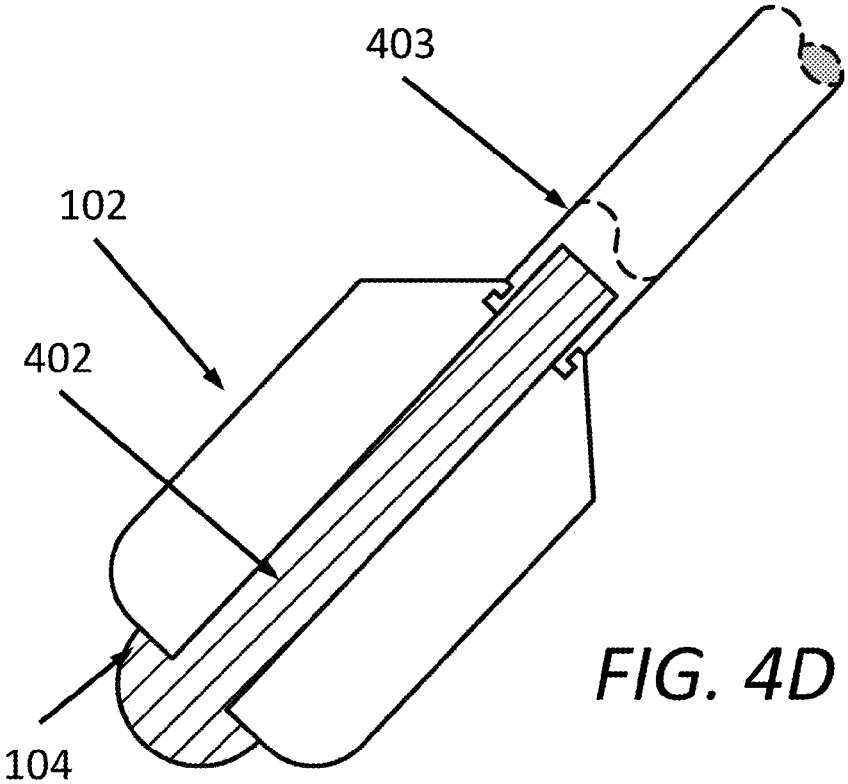
FIG. 4D is a schematic diagram illustrating a cross-section of an embodiment of a dual-mode cane.

In some embodiments, as shown in FIG. 4D, the tip has a basal portion 402 to which each of the low-friction surface 102 and the high-friction surface 104 is attached. In some embodiments, the low-friction surface 102 is free to rotate relative to the basal portion 402. The high-friction surface 104 may be affixed to the low-friction surface 102, and thus may rotate with the low-friction surface 102; the result may be a tip that, at or above the transition angle 103, does not easily slide forward, but still allows sideways searching motions by rolling. In other embodiments, the high-friction surface is affixed to the basal portion 402; for instance, the object bearing the high-friction surface may include an extension 403 that passes through the low-friction surface and attaches fixedly to the basal portion 402. The low-friction surface 102 may be free to rotate about the extension 403; in other words, the extension may function as stationary axle about which the low-friction surface 102 rotates. The basal portion may be a separate piece from the shaft of the cane, or the basal portion may form an integral piece with the shaft of the cane.

The tip 101 may be formed so that the low-friction surface 102 contacts the walking surface when the tip 101 rests on the walking surface at an angle less than or equal to a transition angle 103. The tip 101 may be formed so that the high-friction surface 105 contacts the walking surface when the tip 102 rests on the walking surface at an angle greater than or equal to the transition angle 103. For the purposes herein, the angle the tip forms with the walking surface is the acute angle that the axis 106 running from the tip to the hand with which the user operates the cane 100 forms with a plane tangent to the walking surface at the point of contact of the tip 101 with the walking surface; the axis may be parallel to the shaft 105 if the shaft is straight. The angle the tip 101 forms with the walking surface may be the angle facing the user during operation of the cane 100.

Figure 1C:
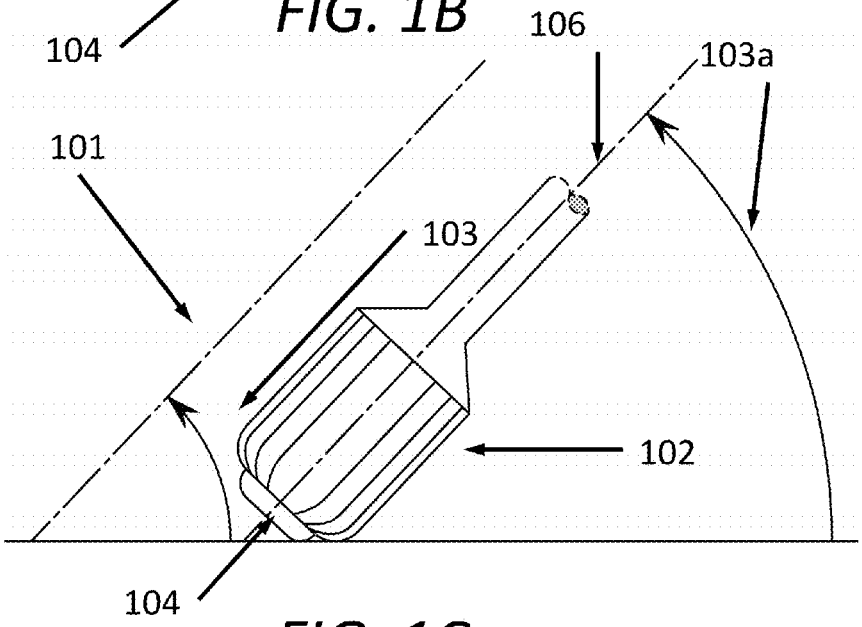
FIG. 1C is a schematic diagram illustrating one embodiment of a dual-mode cane having a filleted disk attachment.
Figure 1D:
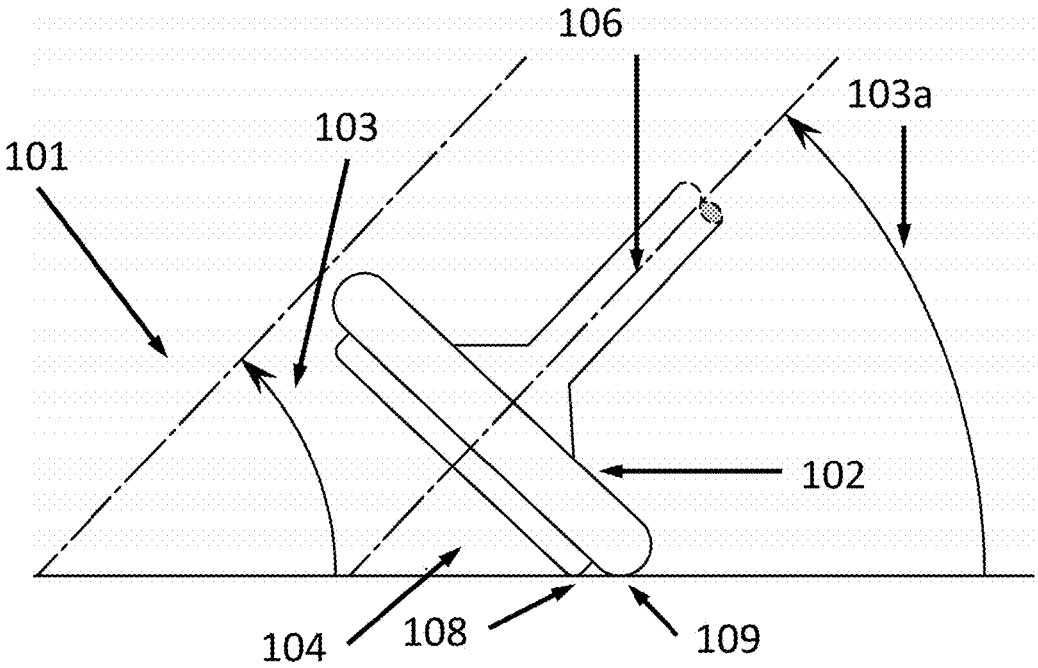
FIG. 1D is a schematic diagram illustrating one embodiment of a dual-mode cane having a filleted disk attachment on a jumbo white cane tip.
Figure 1E:
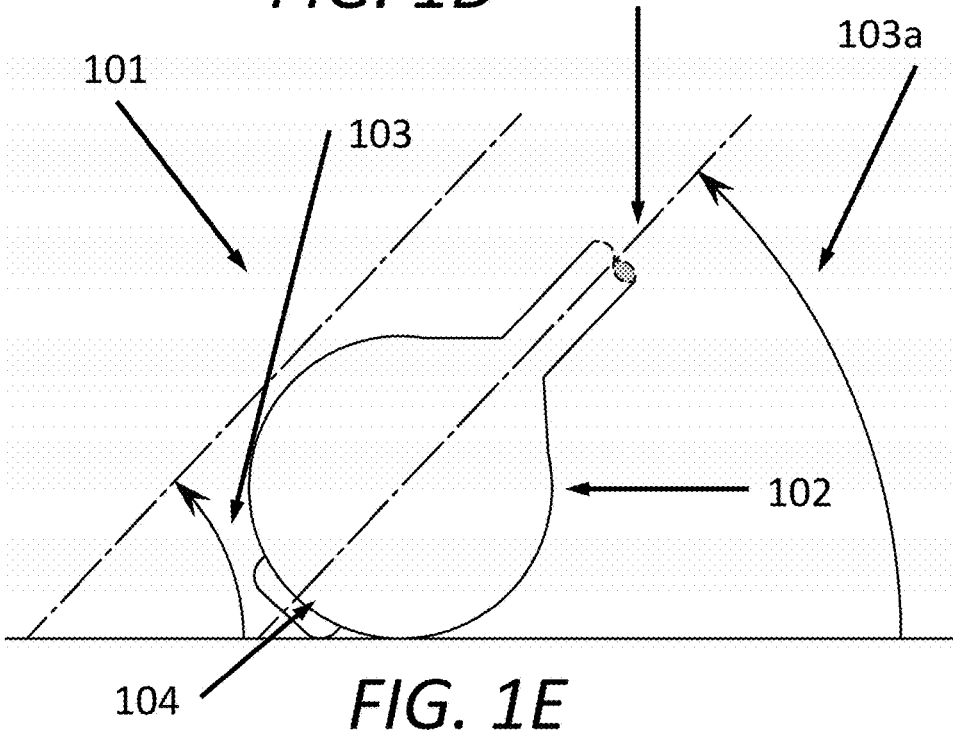
FIG. 1E is a schematic diagram illustrating one embodiment of a dual-mode cane having a filleted disk attachment on a pear-shaped white cane tip.
Figure 1F:
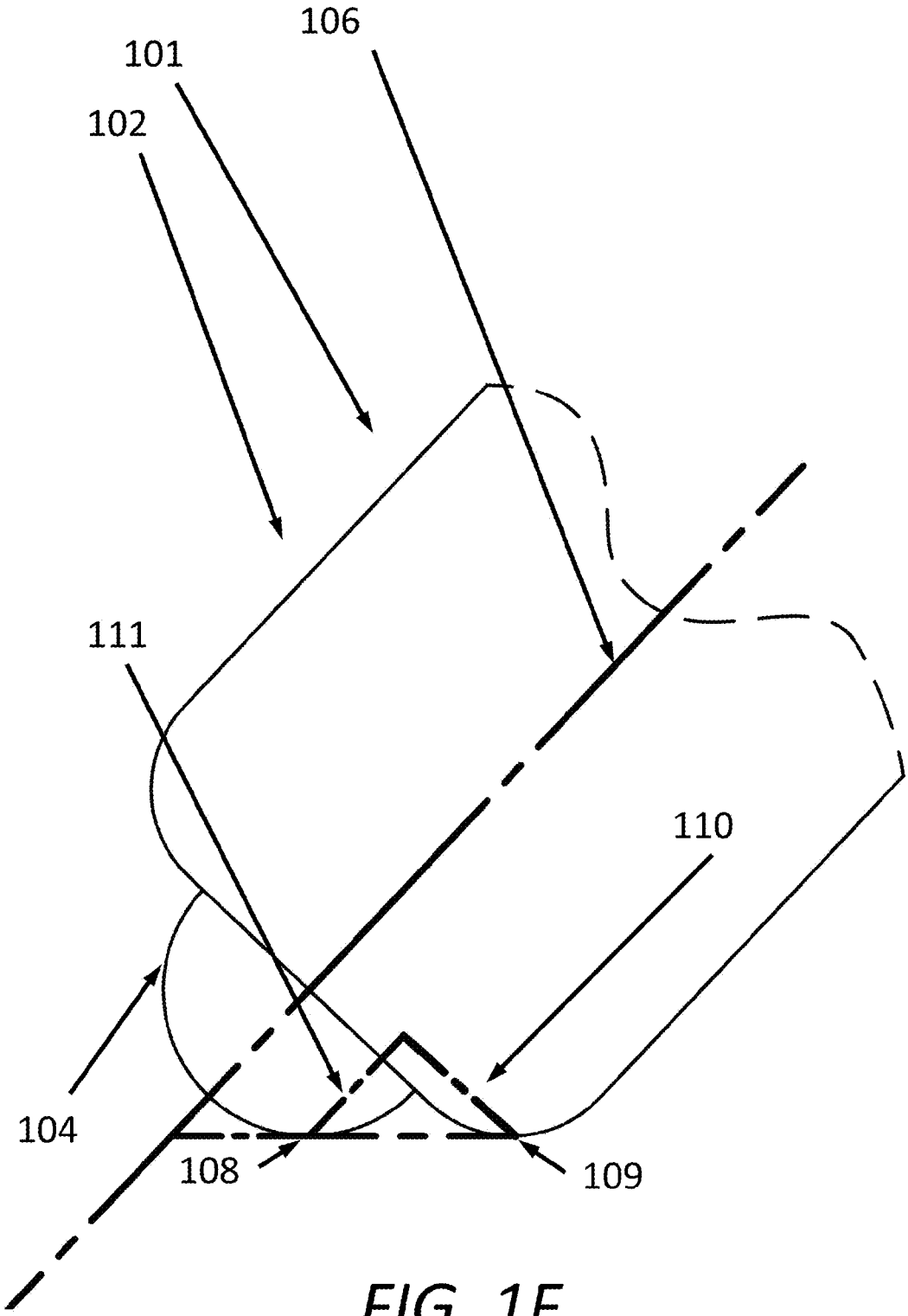
FIG. 1F is a schematic diagram illustrating one embodiment of a transition angle.
Figure 2A:
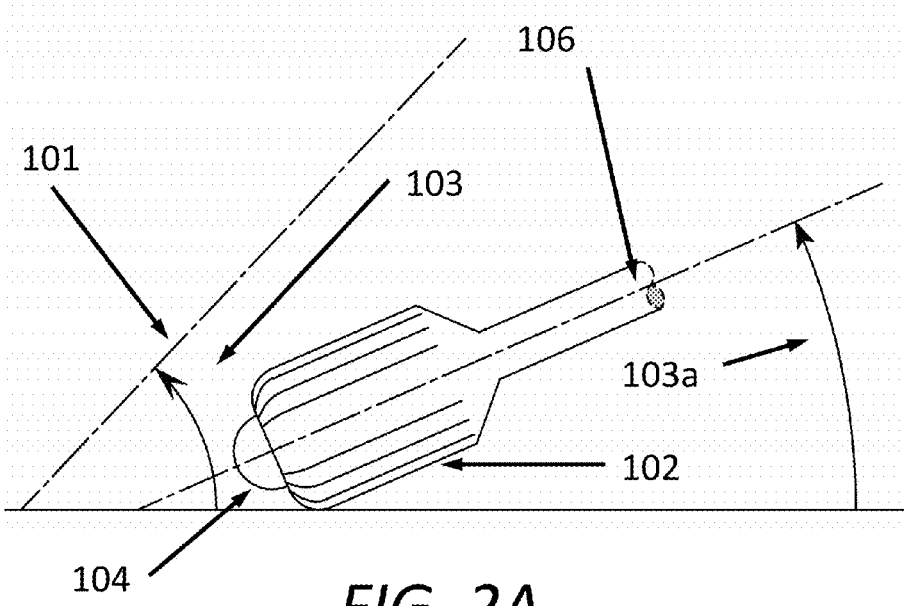
FIG. 2A is a schematic diagram illustrating one embodiment of a dual-mode cane.
Figure 2B:
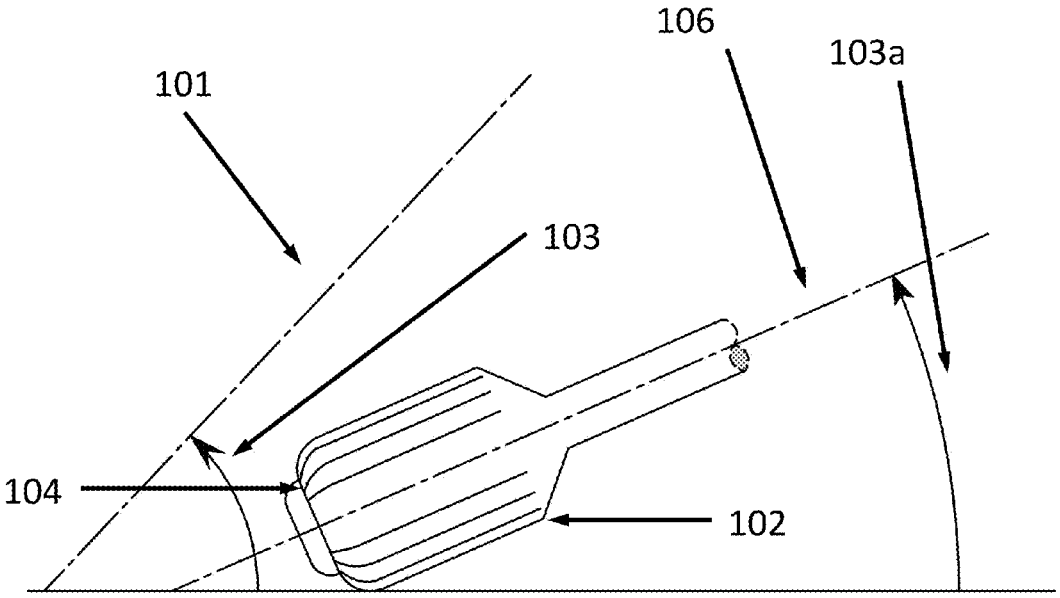
FIG. 2B is a schematic diagram illustrating one embodiment of a dual-mode cane.
Figure 2C:
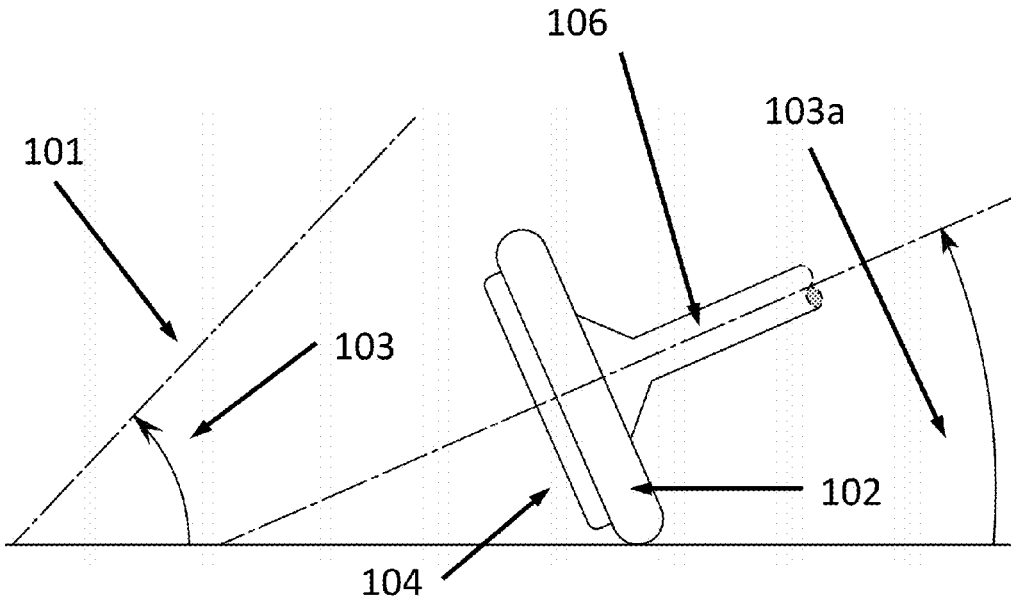
FIG. 2C is a schematic diagram illustrating one embodiment of a dual-mode cane.

As illustrated in FIGS. 1A-1E, the transition angle 103 is an angle at which both the low-friction surface 102 and the high-friction surface 104 simultaneously touch the walking surface. In some embodiments, when the cane has sufficient strength to support some of the weight of the user, the cane may be referred to as a "stability cane." In some embodiments, as shown in FIGS. 2A-2C, when the angle the tip forms with the walking surface is less than the transition angle 103, only the low-friction surface 102 touches the walking surface, and the cane 101 functions as a white cane, which the user can move over the walking surface with very little resistance. In some embodiments, as shown in FIGS. 3A-3C, when the angle 103*a* the tip forms with the walking surface is greater than the transition angle 103, the high-friction surface 104 is the only surface contacting the walking surface, causing the tip to have high friction against the walking surface, and enabling the cane 100 to bear some of a user's weight. The transition angle 103 may be determined by the size and shape of the high-friction surface 104 and the low-friction surface 102, and by the position of the high-friction surface 104 relative to the low-friction surface 102. The transition angle may be selected as an angle substantially greater than the working angle at which the user typically uses the cane when in search mode. In some embodiments, the transition angle 103 is between 40 degrees and 60 degrees.

The high-friction surface 104 may have any form that, in combination with the low-friction surface 102, produces the desired transition angle 103. Where the tip 101 is radially symmetrical about the axis 106, the high-friction surface 104 may be radially symmetrical about the axis 106. As a non-limiting example, shown in FIGS. 1A-1B, 2A, and 3A, the high-friction surface 104 may be substantially hemispherical; the high-friction surface 104 may be any section of any spheroidal form. As another example, the high-friction surface 104 may be substantially disc-shaped. The high-friction surface 104 may be a filleted disc, as shown in FIGS. 1C-1E. The radius of the disc may be larger, for a given transition angle, if the low-friction surface 102 is broader; likewise, if the disc is thick, the radius of the disc will be smaller for a given transition angle than if the disc is thin. The disc may have a wider radius if it has a larger fillet, since a significantly filleted disc does not project as far toward the walking surface as a non-filleted disc. It was found in prototypical models that when the high-friction surface 104 was adhered to the low-friction surface 102, a shape that maximized the area of the high-friction surface 104 that was adhered to the low-friction surface 102 had a reduced likelihood of dislodgement due to shear forces. As a result, a high-friction surface 104 in the form of a disc with a significant fillet may adhere more firmly to the low-friction surface 102 than a non-filleted disc or hemisphere.

As a further non-limiting example, the dimensions of the high-friction surface may be planned graphically as follows: referring to FIG. 1D, the two contact points 108 and 109 may fall on a line, referred to herein as the transition angle line, which forms one leg of the transition angle 103. The axis of the associated cane, when at the transition angle, may be the other side of the transition angle 103. Continuing the example, since there are an infinite number of points 108 that may occupy on the transition angle line, there are an infinite number of attachment shapes that can give the same transition angle. In some embodiments, the high-friction surface has the form of a low profile disk with a filleted edge of quarter circle radius equal to the disk thickness. A manufacturer may use a precision drawing application to draw to scale the tip which is to receive the attachment and draw the disk with a filleted edge as shown in FIG. 1D, so that the point 108 just touches the transition angle line at the transition angle; the dimensions of the disk may then be measured from the drawing.

As a further non-limiting example, the dimensions of the high-friction surface may be calculated numerically using a transcendental equation that may be derived with the skills of analytic geometry and trigonometry. Where the bottom of the low-friction surface forms a right angle to the axis of the cane, a Cartesian coordinate plane that contains the transition angle may be established with the axis of the cane the Y-axis, and the bottom of the low-friction surface forming the X-axis. Continuing the example, in some embodiments the derivation begins with the recognition that the tangent of the transition angle is the ratio of the X-difference 110 of the points 108 and 109, to the Y-difference 111 of the same points 108 and 109, as illustrated by the triangle drawn in FIG. 1F. Use is made of the following symbols: A=transition angle; a=rubber fillet radius; b=rubber disk radius, flat side; c=roller tip fillet radius; d=roller tip radius; S=sin (A); C=cosin(A); T=tan(A). Further continuing the example, the equation T=(x difference)/(y difference)=(((d−c)+cC)−((b−a)+bC))/((c−cS)+(aS)) may be solved for the radius, b, of the attachment.

Figure 5A:
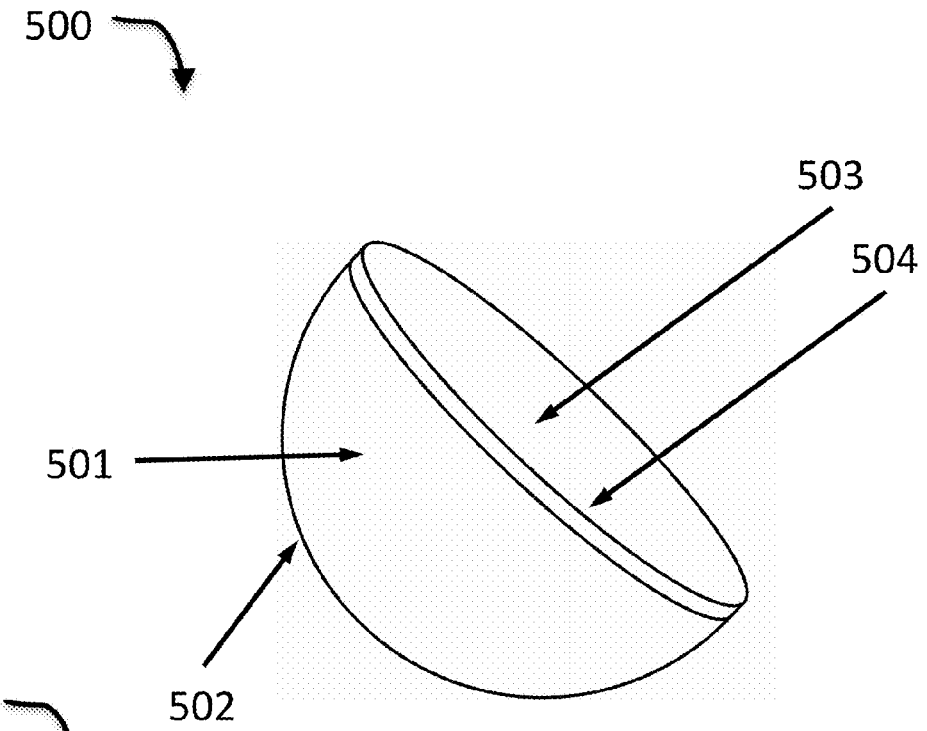
FIG. 5A is a schematic diagram illustration an embodiment of a kit for converting a white cane to a dual-mode cane.
Figure 5B:
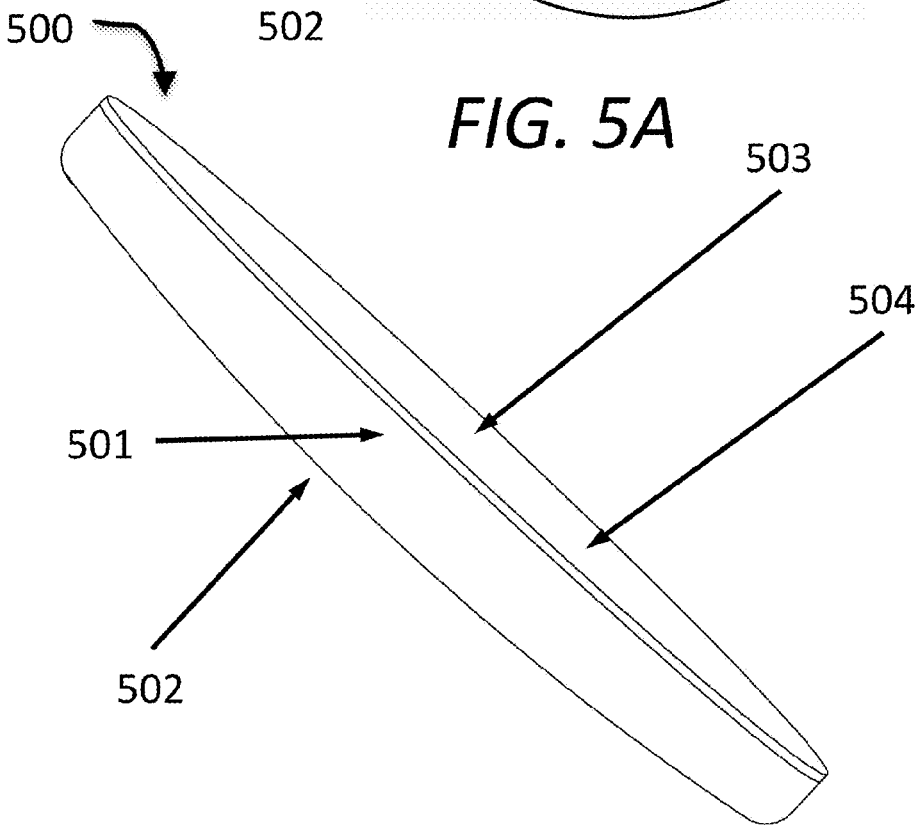
FIG. 5B is a schematic diagram illustration an embodiment of a kit for converting a white cane to a dual-mode cane.

FIGS. 5A-5B illustrate embodiments of a kit 500 for converting a white cane having a radially symmetrical tip to a dual mode cane. The kit 500 includes an attachment 501 having a high-friction surface 502. In some embodiments, the kit 500 includes an adhesive 503.

The attachment 501 may be any object having a high-friction surface 104 as described above in reference to FIGS. 1A-4D. The attachment 501 may be made from any material or combination of materials suitable for constructing the high-friction surface 104 or the object bearing the high-friction surface 104 as described above in reference to FIGS. 1A-4D; for instance, the materials making up the attachment 501 may include elastomeric materials, such as rubber or polyurethane polymer. The attachment 501 may have an additional surface 504 that conforms to the shape of a portion of the tip of the white cane; for instance, the attachment 501 may have a substantially flat back 504 that conforms to a substantially flat part of the tip of the white cane.

The adhesive 503, if included in the kit 500, may be appended to the attachment 501. In some embodiments, the adhesive 503 is spread over the additional surface 504. The adhesive 503 may be covered by a layer of non-adhesive material (not shown), such as backing paper, which the user may remove to expose the adhesive 503. In other embodiments, the adhesive 503 is included separately in the kit; as an example, the adhesive 503 may be included in a receptacle (not shown) such as a bottle or tube. The receptacle may include an applicator, such as an extended, narrowing tube, a sponge or brush, or other material. In other embodiments, the adhesive 503 is not included in the kit 500. The kit 500 may include instructions (not shown), which may describe how to apply the adhesive 503.

The high-friction surface 502 may have any form described above for a high-friction surface 104 in reference to FIGS. 1A-4D. The high-friction surface 502 may have any form that, in combination with the tip of the white cane, results in a desired transition angle 103 as described above in reference to FIGS. 1A-4D. The high-friction surface 502 may be substantially hemispherical; the high-friction surface 502 may be any section of any spheroidal form. As another example, the high-friction surface 502 may be substantially disc-shaped. The high-friction surface 502 may be a filleted disc. The radius of the disc may be larger, for a given transition angle, if the surface of the white cane tip is broader; likewise, if the disc is thick, the radius of the disc will be smaller for a given transition angle than if the disc is thin. The disc may have a wider radius if it has a larger fillet, since a significantly filleted disc does not project as far toward the walking surface as a non-filleted disc.

Figure 6:
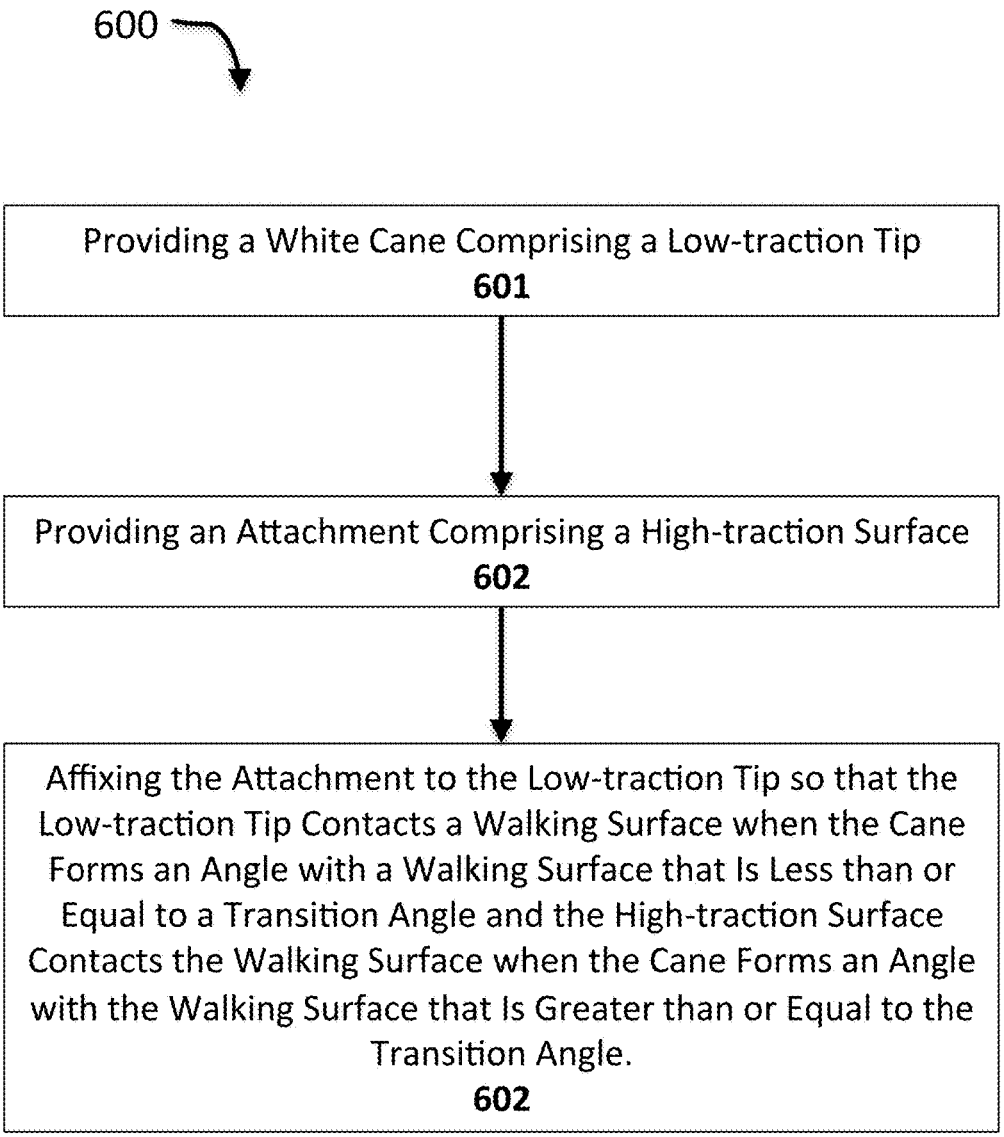
FIG. 6 is a flow diagram illustration an embodiment of a method for converting a white cane to a dual-mode cane.

FIG. 6 is a flow chart illustrating one embodiment of the disclosed method 600 for converting a white cane to a dual-mode cane. As a brief overview, the method 600 includes providing a white cane comprising a low-friction tip (601). The method 600 includes providing an attachment comprising a high-friction surface (602). The method 600 includes affixing the attachment to the low-friction tip so that the low-friction tip contacts a walking surface when the cane forms an angle with a walking surface that is less than or equal to a transition angle and the high-friction surface contacts the walking surface when the cane forms an angle with the walking surface that is greater than or equal to the transition angle (603).

Viewing FIG. 6 in further detail, and as further illustrated by FIGS. 1A-5B, the method 600 includes providing a white cane comprising a low-friction tip (601). The white cane may have a shaft; the shaft may be constructed from any material or combination of materials described above in reference to FIGS. 1A-4D. The shaft may have any form described above in reference to FIGS. 1A-4D. The low-friction tip may be constructed from any material or combination of materials described above as suitable for the construction of a low-friction surface 102 in reference to FIGS. 1A-4D. The low-friction tip may have any form described above for the form of a low-friction surface 102 in reference to FIGS. 1A-4D. In some embodiments, the low-friction tip is radially symmetrical about a first axis.

The method 600 includes providing an attachment comprising a high-friction surface (602). The attachment may be an attachment 501 as described above in reference to FIGS. 5A-5B. The attachment may be constructed from any material or combination of materials described above for the construction of the high-friction surface 104 in reference to FIGS. 1A-4D. The high-friction surface may have any form suitable for a high-friction surface 104 as described above in reference to FIGS. 1A-4D. The high-friction surface 104 may be radially symmetrical about a second axis.

The method 600 includes affixing the attachment to the low-friction tip so that the low-friction tip contacts a walking surface when the cane forms an angle with a walking surface that is less than or equal to a transition angle and the high-friction surface contacts the walking surface when the cane forms an angle with the walking surface that is greater than or equal to the transition angle (603). In some embodiments, where the low-friction tip is radially symmetrical about a first axis, the high-friction surface is radially symmetrical about a second axis, affixing the attachment to the tip further involves affixing the attachment to the low-friction tip so that the first axis aligns with the second axis. For instance, the attachment may be affixed to the end of the tip so that the attachment, and the high-friction surface, is centered on the end of the tip. In some embodiments, affixing the attachment further includes adhering the attachment to the low-friction tip. As an example, where the attachment is provided with an adhesive having a non-adhesive covering, affixing the attachment may include peeling off the non-adhesive covering and pressing the adhesive-covered surface of the attachment against the low-friction tip of the white cane.

In addition to the aid the disclosed embodiments render to the mobility of visually impaired persons, embodiments of the dual-mode cane described herein confer psychological benefits. Frequently in existing use the instruction set of the white cane involves an activity called "sighted-guide." This activity typically works in the following manner: a sighted person says to a blind person that he will be her sighted guide to a common destination, whereupon the blind individual takes the arm of her companion, lifts her cane and holds it vertically off the floor. They then proceed to their common destination. It is the inventor's contention that this ritual, which has been followed religiously for more than half a century, is inherently detrimental to the development of the blind person involved.

The following scenario illustrates the reason therefor: A mother drops off her blind child at the principal's office on the first day of a new school term. The principal tells the child that he will "sight-guide" her to her new class. The child, who already knows the ritual, dutifully raises her cane and holds it vertically in one hand and takes her guide's hand with the other. The principal then proceeds smartly down the hallway with the child in tow. The child moves with hesitancy as she is already familiar with the cane as a search tool. But it is not available to her now, and she is too shy to complain as the principal moves at a faster rate and she is literally dragged forward, her raised cane like an advertising beacon saying, "here comes a blind girl."

Now, consider the situation where the child has a Dual-Mode White Cane as described in the above embodiments. When the principal says he is going to "sight-guide" her, she says, "Good," and they both move forward, but this time she does not have to lift her cane to a useless position, for by virtue of its ability to provide support, the dual-mode cane doubles as a hiking stick and she trudges confidently forward, outpacing the principal, with the cane aiding her stability and discretely enabling her to probe the ground before her as needed for confident movement. This new and improved situation has been brought about by the Dual-Mode Cane which may be used in contact with the floor 100% of the time, either as supportive cane, a rubber-tipped walking stick, or the conventional white cane in its protective search mode. In conclusion, embodiments of the Dual-Mode White Cane thus give the user a level of confidence and independence, and a feeling of being in control of her environment. This adds to the blind person's self-esteem and potential growth in a manner that is absent from the white cane currently in use.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A dual-mode guide cane for vision-impaired users, comprising:

an elongated shaft having a central axis;

a handle disposed at one end of the shaft, the handle extending parallel to the shaft;

a tip disposed at an other end of the shaft, the tip comprising:

a low-friction surface having a first contact location a first distance from the central axis; and a high-friction surface positioned on the low-friction surface, the high-friction surface having a second contact location a second distance from the central axis, wherein the low-friction surface is disposed at a larger radial distance from the central axis than the high-friction surface, so that a line connecting the first contact location and the second contact location forms a transition angle with the central axis of between 40 degrees and 60 degrees;

wherein, when the shaft is held by the vision-impaired user with the tip contacting the horizontal surface and the central axis forming an angle equal to the transition angle with the horizontal surface, the first contact location and second contact location simultaneously contact the horizontal surface;

wherein the vision-impaired user may operate the cane in a searching mode for detecting objects by lowering the handle to place the central axis at less than the transition angle to simultaneously disengage the high friction portion from the horizontal surface and slidably engage the low friction portion with the horizontal surface;

wherein the vision-impaired user may operate the cane in a support mode for supporting users while walking by lifting the handle to place the central axis at greater than the transition angle to simultaneously disengage the low friction portion from the horizontal surface and engage the high friction portion with the horizontal surface; and the low friction surface being curved to present a curved surface to the horizontal surface during said searching mode.

2. The dual-mode cane of claim 1, wherein the high-friction surface is substantially hemispheroidal.

3. The dual-mode cane of claim 1, wherein the high-friction surface is a filleted disc.

4. The dual-mode cane of claim 1, wherein the high-friction surface is adhered to the low-friction surface.

5. The dual-mode cane of claim 1, wherein the high-friction surface is embedded in the low-friction surface.

6. The dual-mode cane of claim 1, wherein the tip has a basal portion to which the low-friction surface is attached.

7. The dual-mode cane of claim of claim 6, wherein the low-friction surface is free to rotate relative to the basal portion about an axis.

8. The dual-mode cane of claim 7, wherein the high-friction surface is affixed to the basal portion.

9. A method for producing a dual-mode guide cane for vision-impaired users, the method comprising:

(a) providing an elongated shaft having a central axis;

(b) disposing a handle at one end of the shaft, the handle extending parallel to the shaft;

(c) disposing a tip at an other end of the shaft, the tip including:

a low-friction surface having a first contact location a first distance from the central axis; and a high-friction surface positioned on the low-friction surface, the high-friction surface having a second contact location a second distance from the central axis, wherein the low-friction surface is disposed at a larger radial distance from the central axis than the high-friction surface, so that a line connecting the first contact location and the second contact location forms a transition angle with the central axis of between 40 degrees and 60 degrees;

wherein, when the shaft is held by the vision-impaired user with the tip contacting the horizontal surface and the central axis forming an angle equal to the transition angle with the horizontal surface, the first contact location and second contact location simultaneously contact the horizontal surface;

wherein the vision-impaired user may operate the cane in a searching mode for detecting objects by lowering the handle to place the central axis at less than the transition angle to simultaneously disengage the high friction portion from the horizontal surface and slidably engage the low friction portion with the horizontal surface;

wherein the vision-impaired user may operate the cane in a support mode for supporting users while walking by lifting the handle to place the central axis at greater than the transition angle to simultaneously disengage the low friction portion from the horizontal surface and engage the high friction portion with the horizontal surface; and (d) providing the low friction surface with a curve to present a curved surface to the horizontal surface during the searching mode.

* * * * *